United States Patent [19]

Shiba et al.

[11] 3,990,899

[45] Nov. 9, 1976

[54] MULTI-LAYERED COLOR PHOTOGRAPHIC LIGHT-SENSITIVE MATERIAL

[75] Inventors: Keisuke Shiba; Takeshi Hirose; Jun Hayashi, all of Minami-ashigara, Japan

[73] Assignee: Fuji Photo Film Co., Ltd., Minami-ashigara, Japan

[22] Filed: May 6, 1974

[21] Appl. No.: 467,539

[30] Foreign Application Priority Data

May 4, 1973 Japan ..... 48-50051

[52] U.S. Cl. ..... 96/74; 96/68; 96/100

[51] Int. Cl.[2] ..... G03C 1/76; G03C 3/00; G03C 1/40

[58] Field of Search ..... 96/74, 100, 22, 68, 96/84 R, 55

[56] References Cited

UNITED STATES PATENTS

| | | | |
|---|---|---|---|
| 3,227,551 | 1/1966 | Barr et al. | 96/3 |
| 3,227,554 | 1/1966 | Barr et al. | 96/55 |
| 3,617,291 | 11/1971 | Sawdey | 96/100 |
| 3,620,745 | 11/1971 | Seymour | 96/68 |
| 3,620,746 | 11/1971 | Barr | 96/3 |
| 3,620,747 | 11/1971 | Marchant et al. | 96/74 |
| 3,703,375 | 11/1972 | Groet et al. | 96/100 |

*Primary Examiner*—David Klein
*Assistant Examiner*—L. V. Falasco
*Attorney, Agent, or Firm*—Sughrue, Rothwell, Mion, Zinn and Macpeak

[57] ABSTRACT

An incorporated-coupler multi-layered color photographic light-sensitive material which comprises a support having thereon at least two light-sensitive emulsion layer units which provide, upon color development, images having substantially different hues, at least one of the light-sensitive emulsion layer units comprising two or more unit layers in which at least one of which unit layers contain an ICC uncolored coupler alone or in combination with another coupler.

15 Claims, 11 Drawing Figures

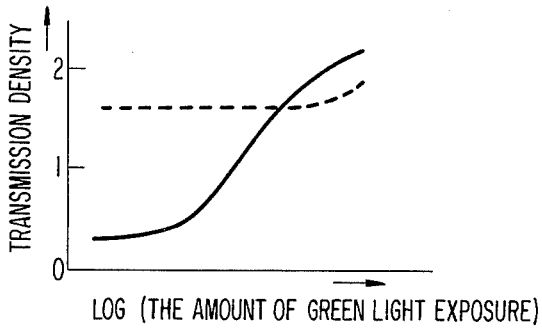
FIG. 9
FIG. 10
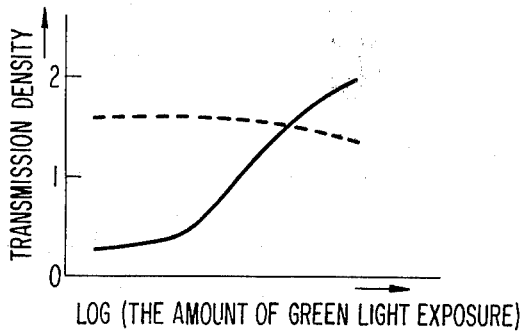
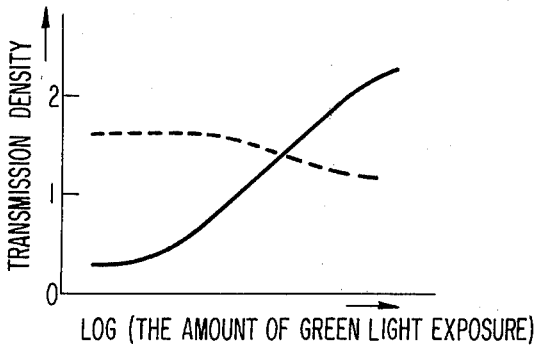
FIG. 11

MULTI-LAYERED COLOR PHOTOGRAPHIC LIGHT-SENSITIVE MATERIAL

BACKGROUND OF THE INVENTION

1. Field of the Invention

The present invention relates to a color photographic light-sensitive material having improved color reproducibility and, more particularly, it is concerned with a color photographic light-sensitive material having excellent color reproducibility improved by adroitly using an interlayer color correction (ICC) uncolored coupler.

2. Description of the Prior Art

Usually, a multi-layered color photographic light-sensitive material comprises a blue-sensitive emulsion layer unit (BL) which contains a yellow coupler and which is mainly sensitive to blue light (substantially shorter than about 500 nm in wave length), a green-sensitive emulsion layer unit (GL) which contains a magenta coupler and which is mainly sensitive to green light (substantially about 500 to 600 nm in wavelength), and a red-sensitive emulsion layer (RL) which contains a cyan coupler and which is mainly sensitive to red light (substantially longer than about 590 nm in wavelength). Each of these light-sensitive emulsion layer units must perform its own independent function required for good color reproduction. For this purpose, an intermediate layer (ML), a filter layer (FL) for filtering out light including ultraviolet light, an anti-halation layer (AHL), and a protective layer (PL) can further be provided. In addition, each light-sensitive emulsion layer unit must independently contain a coupler capable of providing the unit with a suitable spectral sensitivity distribution in a suitable wavelength region and capable of providing images having suitable spectral absorption. However, color photographic light-sensitive materials thus far obtained still possess numerous defects.

A first defect thereof in connection with color reproduction lies in the spectral absorption characteristics of the colored images obtained from the couplers used. That is, sufficient light absorption is not attained in a specific wavelength region and, in addition, the light absorption extends too widely into other undesired wavelength regions. This defect results in a narrow color reproduction region, a shear in hue and, particularly, a reduction in saturation.

A second defect lies in that the image development of a specific light-sensitive emulsion layer can cause the coloration of a coupler contained in a neighboring light-sensitive layer.

A third defect lies in that a sensitizing dye used for the spectral sensitization of a specific light-sensitive emulsion layer diffuses into a neighboring light-sensitive emulsion layer and sensitizes the neighboring light-sensitive layer to impart an unsuitable spectral sensitization distribution.

As methods for removing these defects, the provision of an ML or FL or the incorporation in an ML or FL of a reducing compound such as a hydroquinone derivative (e.g., 2,5-di-t-octylhydroquinone, 2-(1-phenyltetrazol-5-ylthio)-5-n-octadecylthiohydroquinone, etc.), a phenol derivative, ascorbic acid derivative; a scavenger for oxidized color developing agent (primary amine armatic compound); a compound capable of colorlessly coupling; a coupler capable of forming a diffusible dye; an agent for preventing sensitizing dyes or couplers from diffusing, such as fine silver halide grains, colloidal silica, Hectite or a like clay; an anionic, nonionic or cationic surface active agent; a cationic hydrophilic synthetic polymer; a hydrophilic synthetic polymer having hydroquinone derivative; a polymer latex, and the like; have been suggested. However, these improvements are not yet satisfactory.

Another type of method for improving "color separation" lies in the introduction of an element which is positively provided with a "color correcting" function. One such method is a method of using a colored coupler provided with an auto-masking function, for example, as disclosed in, e.g., U.S. Pat. Nos. 2,455,170; 2,449,966; 2,600,788; 2,428,054; 3,148,062; 2,983,608; British Pat. No. 1,044,788, Japanese Pat. application No. 45971/73. However, this method has the defect that the non-image light-struck area is also strongly colored. Therefore, this colored coupler cannot be applied to positive color light-sensitive materials. In addition, the use of the colored coupler tends to increase fog, which deteriorates the graininess or granularity of the color image formed.

Another such method is a method of using a so-called "DIR coupler". The term DIR coupler as used herein means those couplers specified in C. R. Barr, J. R. Thirtle and P. W. Vitlum, Photographic Science and Engineering, vol. 13, pp. 74 – 80 (1969) and ibid, pp. 214 – 217 (1969), or in U.S. Pat. No. 3,227,554. Usually, a DIR coupler is known to bring about interlayer effects. However, it has the defect that the development of the emulsion layer containing the coupler is delayed and the gradation (gamma), maximum color density (Dmax) and effective sensitivity are deteriorated. When a DIR coupler, particularly, a DIR coupler whose coupling position is substituted with an arylthio group or a hetero ring thio group as described in, e.g., U.S. Pat. No. 3,227,554, is added to an emulsion layer of a silver halide of a fine grain size, there is the defect that no or almost no interlayer color-correcting effect is obtained. Therefore, in connection with color reproduction, it is of technical interest to remove these defects.

Thirdly, a method of using a substantially fogged emulsion or a direct positive emulsion in an ML, a method of further using a coupler in combination, a method of using an internally fogged emulsion or an internal latent image-type emulsion, a method of employing Luckey effect, or the like are known. However, these methods of using silver halide emulsions entail a reduction in sharpness due to the light-scattering effect of the grains contained therein on exposure, difficulties in controlling photographic properties of the emulsion itself, photographic side effects, and the like.

Fourthly, a method of controlling the halide composition of the silver halide emulsion itself which is used in each light-sensitive emulsion unit, a method of controlling the interlayer distribution of an antifogging agent, a stabilizer and a restrainer, and the like are known. However, the color-correcting effect obtained by controlling these factors are not satisfactory.

In addition, there are factors involved in development processing. However, color-correcting effects by controlling these factors are not satisfactory, either.

SUMMARY OF THE INVENTION

An object of the present invention is to remove the above-described various defects and, more particularly, to provide a color photographic light-sensitive material having excellent color reproducibility by adroitly designing the stratum structure of each light-sensitive emulsion layer unit and using an ICC uncolored coupler (i.e., coupling compound) or using both an ICC uncolored coupler in an amount as small as possible and a colored coupler in combination.

A further object of the present invention is to provide a color photographic light-sensitive material in which the color-correcting effect is strengthened by an ICC uncolored coupler without a deterioration in the gradation (gamma) of a light-sensitive emulsion layer unit to which the ICC uncolored coupler is added and without a reduction in the Dmax and in the effective sensitivity.

Another object of the present invention is to improve the graininess or sharpness of the color images formed in the light-sensitive emulsion layer unit.

An even further object of the present invention is to provide a color light-sensitive material having improved graininess and being capable of providing excellent gradation by incorporating an ICC uncolored coupler and/or a colored coupler and another coupler separately in the unit layers forming one light-sensitive emulsion layer unit.

Still a further object of the present invention is to provide a method for forming color images having excellent color reproducibility by development-processing the above-described light-sensitive material.

These and other objects of the invention will become apparent from the following description of this invention.

The above-described and other objects of the present invention can be attained as follows. That is, they can be attained by a color photographic light-sensitive material comprising a support having provided thereon at least two light-sensitive emulsion layer units which, upon color development, can provide images having substantially different hues, at least one of the light-sensitive emulsion layer units comprising two or more unit layers at least one of which unit layers contains an ICC uncolored coupler alone or in combination with another coupler.

The term "light-sensitive emulsion layer unit" as used herein means that which contains at least one unit layer.

Also, the color photographic light-sensitive material of the invention can comprise a support having provided thereon at least two silver halide light-sensitive emulsion layer units which, upon color development, provide images having substantially different hues, at least one of the light-sensitive emulsion layer units comprising two or more unit layers comprising silver halide emulsions having different sensitometry gamma values, with an ICC uncolored coupler incorporated in at least one of the unit layers. The ICC uncolored coupler is preferably incorporated in the unit layer comprising a silver halide emulsion having a relatively higher gamma value.

Furthermore, the color photographic light-sensitive material of the present invention comprises a support having provided thereon at least two silver halide light-sensitive emulsion layer units which, upon color development, provide images having substantially different hues, at least one of the light-sensitive emulsion layer units comprising two or more unit layers which comprise silver halide emulsions containing silver halide particles equal or different in mean grain size, and an ICC uncolored coupler incorporated in at least one of the unit layers. The ICC uncolored coupler is preferably incorporated in the unit layer comprising the silver halide emulsion containing silver halide particles of the relatively smaller mean grain size.

Particularly preferably, the color photographic light-sensitive material of the present invention comprises a support having provided thereon a red-sensitive silver halide light-sensitive emulsion layer unit containing a diffusion-resistant cyan coupler which, upon color development, can provide a cyan image; a green-sensitive silver halide light-sensitive emulsion layer unit containing a diffusion-resistant magenta coupler which, upon color development, can provide a magenta image; and a blue-sensitive silver halide light-sensitive emulsion layer unit containing a diffusion-resistant yellow coupler which, upon color development, can provide a yellow image, at least one of the light-sensitive emulsion layer units comprising two or more unit layers comprising silver halide emulsions having different sensitometry gamma values and, (1) at least one ICC uncolored coupler incorporated alone or in combination with another coupler in the unit layer containing the silver halide emulsion containing silver halide particles of a smaller mean grain size and, preferably, a relatively higher gamma value and (2) at least one DIR coupler (including ICC uncolored couplers) being incorporated alone or in combination with another coupler in the unit layer containing the silver halide emulsion containing silver halide particles of a greater mean grain size and, preferably, a relatively lower gamma value.

Furthermore, the color photographic light-sensitive material of the invention comprises a support having provided thereon at least two silver halide light-sensitive emulsion layer units which, upon color development, provide images having substantially different hues, at least one of the light-sensitive emulsion layer units comprising three or more unit layers at least one of which unit layers contains an ICC uncolored coupler alone or in combination with another coupler.

BRIEF DESCRIPTION OF THE DRAWINGS

FIGS. 6 to 8 show stratal structures of samples produced in the Examples and FIGS. 9 to 11 show evaluations made on samples produced in the Examples.

DETAILED DESCRIPTION OF THE INVENTION

Figure 1:
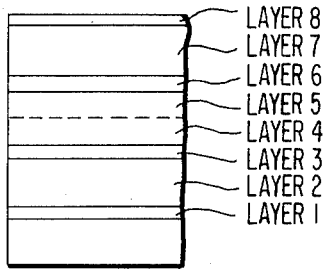
FIGS. 1 to 5 show exemplary stratal structures which can be used in this invention.

The ICC uncolored couplers are included in the so-called "DIR—Development Inhibitor Releasing—Couplers" in the broad sense of this term and can be used in the present invention to provide substantially colorless interlayer effects and, as a result, have the function of color correction. However, the ICC uncolored couplers show particularly greater interlayer effects than are known and provide outstanding interlayer color-correcting effects. The DIR couplers which have heretofore been known, for example, the DIR couplers having an arylthio group, a hetero ring thio group or a like substituent at the coupling position as described in U.S. Pat. No. 3,227,554, show weak color-correcting effects on an adjacent silver halide emulsion layer and rather serve to improve the graininess and sharpness of images by retarding the development of the silver halide emulsion itself which contains the DIR couplers. On the other hand, the ICC uncolored couplers of the present invention do not exert as large an influence on the silver halide emulsion layer itself containing the ICC uncolored couplers but exert an influence on an adjacent or more remote silver halide emulsion layer to result in a marked interlayer color-correcting effect, thus also contributing to the improvement of color reproducibility, and graininess and sharpness of images in silver halide emulsion layers. In addition, the ICC uncolored couplers of the present invention, e.g., a coupler having a benzotriazolyl group of a naphthotriazolyl group at the 1-position; provide a stronger interlayer color-correcting effect than the DIR couplers described in, e.g., German Pat. OLS No. 2,322,165, which fact may be attributed to the fact that the benzotriazole coupling off group is more easily eliminated upon coupling and the couplers of the present invention adsorb on the silver halide or the silver deposit with difficulty.

Where a fine grained silver halide emulsion layer is used, the above-described DIR couplers having an arylthio group, a hetero ring thio group or a like substituent provide almost no interlayer effects but overwhelmingly provide intralayer effects and cause a reduction in both gamma and color density, thus substantially providing merely an intralayer development-restraining effect.

In contrast, the ICC uncolored couplers of the present invention provide interlayer effects as well as an intralayer development-restraining effect even when a fine grained emulsion is used, thus providing a great interlayer color-correcting effect. This is really a surprising effect not previously known. The so-called "DIR couplers" are couplers which have an eliminatable diffusing group which can be eliminated during the color development step and exert a development-retarding action. The eliminatable (or coupling off) groups will be described in detail hereinafter. For example, the general formula [I], [II], [III] and [IV] described hereinafter, the eliminatable groups $Z_1$, $Z_2$ and $Z_3$ each represents an arylmonothio group or a hetero ring thio group. This hetero ring moiety represents a tetrazolyl group, a triazolyl group, an oxazolyl group, an imidazolyl group, an oxadiazolyl group, a thiadiazolyl group, a benzothiazolyl group, a pyrimidyl group, a pyridinyl group or the like, preferably, a triazole-ring containing hetero ring or a diazole-ring-containing hetero ring. These are described in, e.g., U.S. Pat. Nos. 3,617,291; 3,622,328; 3,632,373; 3,620,745; 3,620,747; 3,615,506; 3,703,375; British Pat. Nos. 1,201,110; 1,261,061; 1,269,075; 1,269,073; U.S. Pat. No. 3,933,500, etc. Of these, the ICC uncolored coupling compounds referred to in the present invention are those which have as the eliminatable group an iodine atom or a heterocyclic imino group (e.g., 1-triazolyl, 1-diazolyl, etc.). These are described in Japanese Pat. application No. 33238/73, etc. More specifically, the heterocyclic imino group ca be a triazole or diazole hetero ring residue represented by the following general formula;

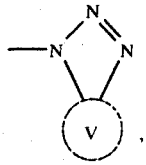

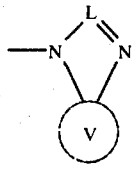

or

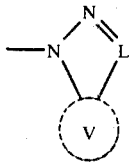

wherein V represents an aromatic ring of the benzene series or a heteroaromatic ring containing at least one nitrogen atom, L represents a methine group or a derivative thereof, and V can be substituted with an amino group, an acylamino group, a halogen atom, an alkyl group, a nitro group, an alkoxy group, an alkylthio group, an arylthio group, an aryl group or the like. This heterocyclic imino group also can have another coupling nucleus (i.e., the general formulae (I), (II), (III) or (IV) hereinafter described but without the $Z_1$, $Z_2$ or $Z_3$ substituent) by forming a bis derivative or through a divalent bond or group. In addition, this group can contain a ballasting group containing 8 to 32 carbon atoms. A preferred embodiment of the above triazole hetero ring has the general formula

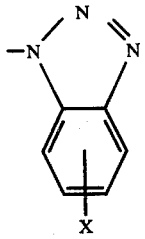

wherein X represents a hydrogen atom, a halogen atom, an alkyl group or the atoms necessary to form a naphthalene ring together with the benzene ring containing the X substituent.

As the couplers which can be used in the present invention, there are those compounds capable of forming color by color development using a primary amine aromatic developing agent such as a phenylenediamine derivative or an aminophenol derivative. Suitable examples are 5-pyrazolone couplers, cyanoacetylcoumarone couplers, open-chain acylacetonitrile couplers, acylacetyl couplers, acylacetanilide couplers, alkoylacetanilide couplers, aroylacetanilide couplers, pivaloylacetanilide couplers, naphthol couplers, phenol couplers, and the like.

More specifically, as a magenta coupler, a 5-pyrazolone coupler, a cyanoacetylcoumarone coupler, a indazolone coupler and the like are used. In particular, those magenta couplers represented by the following general formula [I] are useful;

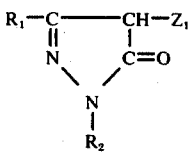

[I]

wherein $R_1$ represents an alkyl group selected from primary, secondary and tertiary alkyl groups (e.g., a methyl group, a propyl group, an n-butyl group, a t-butyl group, a hexyl group, a 2-hydroxyethyl group, 2-phenylethyl group, etc.), an aryl group (e.g., a phenyl group, a tolyl group, an m-acylaminophenyl group, etc.), an alkoxy group (e.g., a methoxy group, an ethoxy group, a benzyloxy group, etc.), an aryloxy group (e.g., a phenoxy group, etc.), heterocyclic group (e.g., a quinolinyl group, a pyridyl group, a piperidyl group, a benzofuranyl group, an oxazolyl group, etc.), an amino group (e.g., a methylamino group, a diethylamino group, a dibutylamino group, a phenylamino group, a tolylamino group, a 4-(3-sulfobenzamino)anilino group, a 2-chloro-5-acylaminoanilino group, a 2-chloro-5-alkoxycarbonylanilino group, a 2-tolylfluoromethylphenylamino group, etc.), a carbonamido group (e.g., an alkylcarbonamido group, an arylcarbonamido group, a heterocyclic carbonamido group, a sulfonamido group, a heterocyclic sulfonamido group, etc.), an ureido group (e.g., an alkylureido group, an arylureido group, a heterocyclic ureido group, etc.); $R_2$ represents an alkyl group selected from primary, secondary and tertiary alkyl groups (e.g., a methyl group, an ethyl group, a t-butyl group, a benzyl group, etc.), an aryl group (e.g., a naphthyl group, a phenyl group, a 2,4,6-trichlorophenyl group, a 2-chloro-4,6-dimethylphenyl group, a 2,6-dichloro-4-methoxyphenyl group, a 4-methylphenyl group, a 4-acylaminophenyl group, a 4-alkylaminophenyl group, a 4-trichloromethylphenyl group, a 3,5-dibromophenyl group, etc.), a heterocyclic group (e.g., a benzofuranyl group, a naphthoxazolyl group, a quinolinyl group, etc.), or the like; and $Z_1$ represents a hydrogen atom or a group which can be eliminated upon color development.

When the general formula [I] represents a DIR coupler, $Z_1$ represents a residue which, upon development, releases a development restrainer. Examples of $Z_1$ are an arylmonothio group (e.g., a 2-aminophenylthio group, a 2-hydroxycarbonylphenylthio group, etc.). a heterocyclic monothio group (e.g., a tetrazolyl group, a triazolyl group, an oxazolyl group, an oxadiazolyl group, a diazolyl group, a thiazyl group, a thiadiazolyl group, etc.) and, preferably, a heterocyclic imino group (e.g., a 1-benzotriazolyl group, a 1-naphthotriazolyl group, a 1-indazolyl group, a 2-benzotriazolyl group, a 1-$\beta,\beta'$-naphthotriazolyl group, etc.), described in, e.g., U.S. Pat. Nos. 3,148,062; 3,227,554; 3,615,506; and 3,701,783.

The yellow couplers include, e.g., an open-chain acylacetanilide coupler (e.g., a pivaloylacetanilide coupler, an aroylacetanilide coupler, etc.), an open-chain acylacetonitrile coupler, and the like. In particular, those yellow couplers represented by the following general formula [II] are useful;

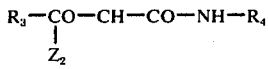

[II]

wherein $R_3$ represents a primary, secondary or tertiary alkyl group having 1 to 18 carbon atoms (e.g., a t-butyl group, a 1,1-dimethylpropyl group, a 1,1-dimethyl-1-methoxyphenoxymethyl group, a 1,1-dimethyl-1-ethylthiomethyl group, etc.) or an aryl group (e.g., a phenyl group, an alkyl phenyl group such as a 3-methylphenyl group, a 3-octadecylphenyl group, etc., an alkoxyphenyl group such as a 2-methoxyphenyl group, a 4-methoxyphenyl group, etc. a halophenyl group, a 2-halo-5-alkamidophenyl group, a 2-chloro-5-[$\alpha$-(2,4-di-t-amylphenoxy)butylamido]phenyl group, a 2-methoxy-5-alkamidophenyl group, a 2-chloro-5-sulfonamidophenyl group, etc.); $R_4$ represents an aryl group (e.g., a 2-chlorophenyl group, a 2-halo-5-alkamidophenyl group, a 2-chloro-5-[$\alpha$-(2,4-di-t-amylphenoxy) acetamido]phenyl, a 2-chloro-5-(4-methylphenylsulfonamido)phenyl group, a 2-methoxy-5-(2,4-di-t-amylphenoxy)-acetamidophenyl group, etc.); and $Z_2$ represents a hydrogen atom or a group which can be eliminated upon color development.

When the general formula [II] represents a DIR coupler $Z_2$ represents a residue which, upon development, releases a development restrainer. Examples thereof are an arylmonothio group (e.g., a phenylthio group, a 2-carboxyphenylthio group, etc.), a heterocyclic thio group and, an imino group, preferably, such as a 1-benzotriazole group and a 1-benzodiazole group, described in, e.g., Japanese Pat. application No. 33238/73.

The cyan couplers include, e.g., a naphthol coupler and a phenol coupler. In particular, cyan couplers represented by the following general formulae [III] and [IV] are useful;

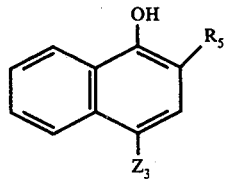

[III]

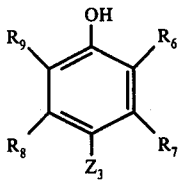

[IV]

wherein $R_5$ represents an substituent of the type employed in cyan couplers, such as a carbamyl group (e.g., an alkylcarbamyl group, an arylcarbamyl group such as a phenylcarbamyl group, a heterocyclic carbamyl group such as a benzothiazolylcarbamyl group, etc.), a sulfamyl group (e.g., an alkylsulfamyl group, an arylsulfamyl group, a heterocyclic sulfamyl group, etc.), an alkoxycarbonyl group, an aryloxycarbonyl group, or the like; $R_6$ represents an alkyl group, an aryl group, a heterocyclic group, an amino group (e.g., an amino group, an alkylamino group, an arylamino group, etc.), a carbonamido group (e.g., an alkylcarbonamido group, an arylcarbonamido group, etc.), a sulfonamido group, a sulfamyl group (e.g., an alkylsulfamyl group, an arylsulfamyl group, etc.), a carbamyl group, or the like; $R_7$, $R_8$ and $R_9$ each represents the group defined for $R_6$ or represents a halogen atom, an alkoxy group or the like; and $Z_3$ represents a group which can be eliminated upon color development. When the general formulae [III] and [IV] represent a DIR coupler, $Z_3$ represents an iodine atom or a group as defined for $Z_2$.

As was described before, the ICC uncolored couplers as referred to in the present invention are included in the so-called "DIR coupler" in its broad sense. However, the ICC uncolored couplers provide less intralayer effects and marked interlayer color-correcting effects as compared with other DIR couplers. For example, the couplers represented by the following general formula [I*a*], [II*a*], [III*a*] or [IV*a*] are useful.

Preferable ICC magenta couplers are represented by the following general formula [Ia];

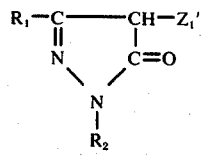

[Ia]

wherein $R_1$ and $R_2$ are the same as defined in the general formula [I], and $Z_1'$ represents a heterocyclic imino group (e.g., a 1-benzotriazolyl group, a 1-benzodiazolyl group, etc., described in Japanese Pat. Application No. 33238/73).

Preferable ICC yellow uncolored couplers are represented by the following general formula [IIa];

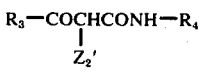

[IIa]

wherein $R_3$ and $R_4$ are the same as defined in the general formula [II], and $Z_2'$ is the same as $Z_2'$ (e.g., the group described in Japanese Patent Application No. 33238/73, etc.).

Preferable ICC cyan uncolored couplers are represented by the following general formulae [IIIa] and [IVa];

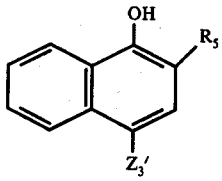

[IIIa]

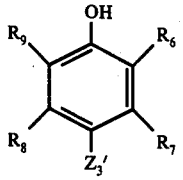

[IVa]

wherein $R_5$, $R_6$, $R_7$, $R_8$ and $R_9$ are the same as defined in the general formulae [III] and [IV], and $Z_3'$ represents a heterocyclic imido group (e.g., a 2-benzotriazolyl group, a 2-benzodiazolyl group, etc.) or, preferably, an iodine atom or an imino group described in Japanese Pat. Publication No. 28836/70.

The couplers which can be used in the present invention are 4-equivalent or 2-equivalent couplers conventionally employed for color photographic light-sensitive materials, and can be of an uncolored type or a colored type. For example, in the general formula [I], [II], [III] or [IV], $Z_1$, $Z_2$ and $Z_3$ each represents a hydrogen atom or a group which can be eliminated in the color development step and, preferably, represents a group which gives rise to a 2-equivalent coupler. For example, $Z_1$ represents a hydrogen atom, an acyloxy group, an aryloxy group, a halogen atom, a thiocyano group, a di-substituted amino group, an aryloxycarbonyloxy group, an alkoxycarbonyloxy group, a benzotriazolyl group, an indazolyl group, an arylazo group, a heterocyclic azo group or the like. Examples thereof are described in U.S. Pat. Nos. 3,227,550; 3,252,924; 3,311,476; 3,419,391; German Pat. OLS No. 2,015,867; and the like. $Z_2$ represents a hydrogen atom, a halogen atom (particularly, a fluorine atom), an acyloxy group, an aryloxy group, a heteroaromatic carbonyloxy group, a sulfimido group, an alkylsulfoxy group, an arylsulfoxy group, a phthalimido group, a dioxoimidazolidinyl group, a dioxoxazolidinyl group, an indazolyl group, a dioxothiazolidinyl group, or the like. Examples thereof are described in, e.g., U.S. Pat. Nos. 3,227,550; 3,253,924; 3,277,155; 3,265,506; 3,408,194; 3,415,652; French Pat. 1,411,384; British Pat. No. 944,490; 1,040,710; 1,118,028; German Pat. OLS Nos. 2,057,941; 2,163,812; 2,213,461; 2,219,917; and the like. $Z_3$ represents a hydrogen atom, a halogen atom (e.g., a chlorine atom, a bromine atom, etc.), an indazolyl group, a cyclic imido group, an acyloxy group, an aryloxy group, an alkoxy group, a sulfo group, an arylazo group, a heterocyclic azo group, or the like. Examples thereof are described in U.S. Pat. Nos. 2,423,730; 3,227,550; 3,311,476; British Pat. No. 1,084,480; 1,165,563; and the like. In addition, the couplers of the present invention can be colored couplers. Colored couplers are described in, e.g., U.S. Pat. Nos. 2,983,608; 3,005,712; 3,034,892; British Pat. Nos. 937,621; 1,269,073; 586,211; 627,814; French Pat. Nos. 980,372; 1,091,903; 1,257,887; 1,398,308; 2,015,649; etc.

Specific examples of the couplers which can be used in the present invention are shown below. The invention, however, is not to be interpreted as being limited to these couplers.

[Yellow Couplers]

1. α-{3-[α-(2,4-Di-tert-amylphenoxy)butyramido]-benzoyl}-2-methoxyacetoanilide
2. α-Acetoxy-α-3-[γ-(2,4-di-tert-amylphenoxy)-butyramido]-benzoyl-2-methoxyacetanilide
3. N-(4-Anisoylacetamidobenzenesulfonyl)-N-benzyl-N-toluidine
4. α-(2,4-Dioxo-5,5-dimethyloxazolidinyl)-α-pivaloyl-2-chloro-5-[α-(2,4-di-tert-amylphenoxy)-butyramido]acetanilide
5. α-(4-Carboxyphenoxy)-α-pivaloyl-2-chloro-5-[α-(2,4-di-tert-amylphenoxy)butyramido-]acetanilide
6. α-[3-(1-Benzyl-2,4-dioxo)hydantoin]-α-pivaloyl-2-chloro-5-[α-(2,4-di-tert-amylphenoxy)-butyramido]acetanilide

[Magenta Couplers]

7. 1-(2,4,6-Trichlorophenyl)-3-[3-(2,4-di-tert-amylphenoxyacetamido)benzamido]-5-pyrazolone
8. 1-(2,4,6-Trichlorophenyl)-3-{3-[α-(2,4-di-tert-amylphenoxy)-acetamido]benzamido}-4-acetoxy-5-pyrazolone
9. 1-(2,4,6-Trichlorophenyl)-3-tridecylamido-4-(4-hydroxyphenyl)azo-5-pyrazolone
10. 1-(2,4,6-Trichlorophenyl)-3-[(3-tridecanoylamino-6-chloro)anilino]-5-pyrazolone
11. 1-(2,4,6-Trichlorophenyl)-3-(3-tetradecyloxycarbonyl-6-chloro)anilino-4-(1-naphthylazo)-5-pyrazolone
12. 1-(2,4-Di-chloro-6-methoxyphenyl)-3-[(3-tridecanoylamino-6-chloro)anilino]-4-benzyloxycarbonyloxy-5-pyrazolone

[Cyan Couplers]

13. 1-Hydroxy-N-[γ-(2,4-di-tert-amylphenoxypropyl)]-2-naphthamide
14. 1-Hydroxy-4-[2-(2-hexyldecyloxycarbonyl)-phenylazo]-2-[N-(1-naphthyl)]naphthamide 15. 1-Hydroxy-4-chloro-N-[α-(2,4-di-tert-amylphenoxy)butyl]-2-naphthamide
16. 5-Methyl-4,6-dichloro-2-[α-(3-n-pentadecylphenoxy)-butylamino]phenol Of the above-illustrated couplers, Couplers 9, 11 and 14 are examples of colored couplers for color correction.

[DIR Couplers]

17. α-Benzoyl-α-(2-benzothiazolylthio)-4-[N-(γ-phenylpropyl)-N-(4-tolyl)sulfamyl]acetanilide
18. 1-14-[γ-(2,4-Di-tert-amylphenoxybutyramido)-phenyl]-3-piperidinyl-4-(1-phenyl-5-tetrazolylthio)-5-pyrazolone
19. 1-(2,4,6-Trichlorophenyl)-3-{4-[α-(2,4-di-tert-amylphenoxy)butyramido]anilino}-4-(1-phenyl-5-tetrazolyl-thio)-5-pyrazolone
20. 1-[4-{α-(2,4-Di-tert-amylphenoxy)acetamido}-phenyl]-3-methyl-4-(5- or 6-bromo-1-benzotriazolyl)-5-pyrazolone
21. 1-Hydroxy-4-iodo-N-dodecyl-2-naphthamide
22. 5-Methoxy-2-[α-(3-n-pentadecylphenoxy)-butyramido]-4-(1-phenyl-5-tetrazolylthio)phenol
23. N-[α-(2,4-Di-tert-amylphenoxy)acetyl]-ω-(1-phenyl-5-tetrazolylthio)-m-aminoacetophenone
24. α-Pivaloyl-α-(5- or 6-bromo-1-benzotriazolyl)-5-[α-(2,4-di-tert-amylphenoxy)propionamido]-2-chloro-acetanilide
25. 1-Benzyl-3-[2-chloro-5-(tetradecanamido)anilino]-4-(5- or 6-methyl-1-benzotriazolyl)-5-pyrazolone
26. 1-[4-{α-(2,4-Di-t-amylphenoxy)-acetamido-}phenyl]-3-ethoxy-4-(5- or 6-bromo-benzotriazolyl)-5-pyrazolone Of the above-illustrated DIR couplers, Couplers 20, 21, 24, 25 and 26 are preferable examples of ICC uncolored couplers referred to in the present invention.

The couplers which can be used in the present invention can be synthesized using known processes or a process described in Japanese Pat. application No. 33238/73.

In the present invention at least one light-sensitive emulsion layer unit comprises two or more unit layers each of which contains an ICC uncolored coupler alone or, preferably, in combination with another coupler in different ratios. Thus, remarkable color-correcting effects can be obtained by using the ICC uncolored coupler in lower amounts as compared with the case of a one-layer structure light-sensitive emulsion layer using an ICC uncolored coupler in a definite ratio based on the other coupler used in combination.

In general, the greater the grain size of the silver halide emulsion of the light-sensitive emulsion layer to which the DIR couplers are added and the faster the initial rate of development, or roughly speaking, the higher the sensitivity of the emulsion, the color-correcting effect of DIR couplers on an adjacent emulsion layer unit becomes greater. However, the ICC uncolored couplers of the present invention, particularly, those couplers represented by the general formula [I*a*], [II*a*], [III*a*] or [IV*a*], are characterized in that they not only exert strong color-correcting effects on an adjacent emulsion layer unit under the above-described conditions but also exert strong interlayer color-correcting effects as compared with the DIR couplers described in, e.g., U.S. Pat. No. 3,227,554; even when the light-sensitive emulsion to which the DIR couplers are added contains a fine grained silver halide emulsion or a low sensitive silver halide emulsion. Furthermore, the use of the ICC uncolored coupler reduces the defect encountered when the DIR coupler is used, i.e., the reduction in the Dmax of a light-sensitive emulsion layer unit containing the DIR coupler or the deterioration of the gradation (Gamma). An effective color-correcting effect can be obtained by using the ICC uncolored coupler in a higher ratio in such a unit layer, of the unit layers constituting one light-sensitive emulsion layer unit, which is positioned nearer the light-sensitive emulsion layer to be color-corrected.

In addition, when one light-sensitive emulsion layer unit comprises a plurality of unit layers and the ICC uncolored coupler is used therein in accordance with the present invention, the light-sensitive emulsion layer itself becomes susceptible to another color-correcting effect. This is quite advantageous for the improvement of color reproduction and is a really surprising fact. In particular, it is advantageous to use the ICC uncolored coupler of the present invention in higher ratio for a unit layer containing a silver halide emulsion having less sensitivity, finer silver halide grains or a silver halide emulsion capable of providing a more contrasty gradation.

In one light-sensitive emulsion layer unit, it is advantageous to use the ICC uncolored coupler of the present invention in one unit layer in a higher ratio and to use a colored coupler in another unit layer. It is particularly advantageous to use the ICC uncolored coupler in a higher ratio in the unit layer which is positioned nearer the emulsion layer having a spectral sensitivity peak in a wave-length region longer than that of the light-sensitive emulsion layer unit in which the ICC uncolored coupler is to be incorporated, and to use the colored coupler in the unit layer which is positioned nearer the emulsion layer having a spectral sensitivity peak in a shorter wave-length region. It is desirable to position the light-sensitive layer unit, in which the ICC uncolored coupler is to be used, on or above the light-sensitive emulsion layer to be color-corrected with respect to a support. Thus, while undesired absorption of the colored image formed by the ICC uncolored coupler in the shorter wave-length region is corrected by the masking action of the colored coupler, the ICC uncolored coupler can provide a color-correcting effect on the absorption of the longer wavelength region. This can provide astounding technical effects in the art of color reproduction.

Examples of using the ICC uncolored couplers of the present invention are as follows. It is preferable to use, in at least one unit layer constituting a red-sensitive silver halide emulsion layer unit, the ICC cyan uncolored coupler in combination with a cyan coupler and/or a colored cyan coupler. In this method, the ICC cyan uncolored coupler can be replaced by an ICC yellow uncolored coupler or by the combination of the ICC cyan uncolored coupler and the ICC yellow uncolored coupler. It is preferable to use, in at least one unit layer constituting a green-sensitive silver halide emulsion layer unit, the ICC magneta uncolored coupler in combination with a magenta coupler and/or a colored magenta coupler. In this method, the ICC magenta uncolored coupler can be replaced by an ICC yellow uncolored coupler or by the combination of the ICC magenta uncolored coupler and the ICC yellow uncolored coupler. Also, it is preferable to use, in at least one unit layer constituting a blue-sensitive silver halide emulsion layer unit, an ICC yellow uncolored coupler in combination with a yellow coupler.

Specific examples of a stratum structure in the present invention are illustrated below by reference to FIGS. 1 to 5 which, however, are not to be interpreted as being limitative of of the present invention.

In FIG. 1, the first layer represents an AHL (antihalation), the second layer an RL, the third layer an FL (magenta), the fourth layer a first GL, the fifth layer a second GL, the sixth layer an FL (yellow), the seventh layer a BL, and the eighth layer a PL (protective). The first GL is more sensitive than the second GL, contains coarse silver halide grains, and contains an ICC uncolored coupler and a magenta coupler, whereas the second GL contains a colored magenta coupler.

Figure 2:
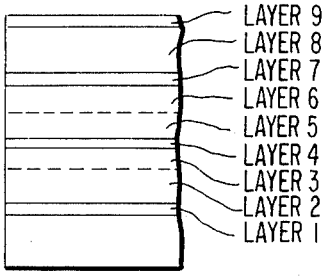

In FIG. 2, the first layer represents an AHL, the second layer a first RL, the third layer a second RL, the fourth layer an ML, the fifth layer a first GL, the sixth layer a second GL, the seventh layer an FL (yellow), the eighth layer a BL and the ninth layer a PL. The first RL contains a cyan coupler and the second RL contains an ICC uncolored coupler and a cyan coupler. The first GL contains an ICC uncolored coupler and a magenta coupler, whereas the second GL contains a colored magenta coupler.

Figure 3:
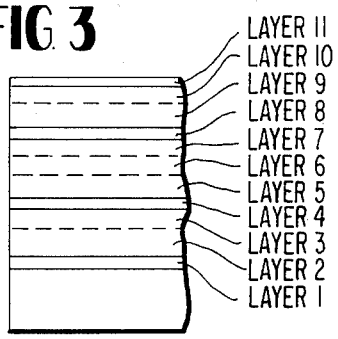

In FIG. 3, the first layer represents an AHL, the second layer a first RL, the third layer a second RL, the fourth layer an ML, the fifth layer a first GL, the sixth layer a second GL, the seventh layer a third GL, the eighth layer an FL (yellow), the ninth layer a first BL, the tenth layer a second BL and the eleventh layer a PL. The first RL contains a colored coupler and a cyan coupler, and the second RL contains an ICC uncolored coupler and a cyan coupler. The first GL contains an ICC uncolored coupler and a magenta coupler, the second GL contains a colored magenta coupler, a magenta coupler and an ICC magenta coupler, and the third GL contains a magenta coupler. The first BL contains an ICC uncolored coupler and a yellow coupler, and the second BL contains a yellow coupler.

Figure 4:
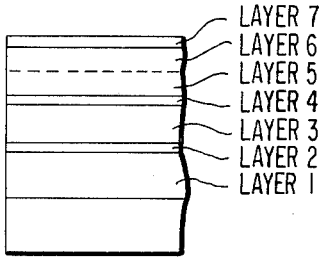

In FIG. 4, the first layer represents a BL, the second layer an FL (blue), the third layer an RL, the fourth layer an ML, the fifth layer a first GL, the sixth layer a second GL and the seventh layer a PL. The first GL contains an ICC uncolored coupler and a magenta coupler, and the second GL contains a magenta coupler.

Figure 5:
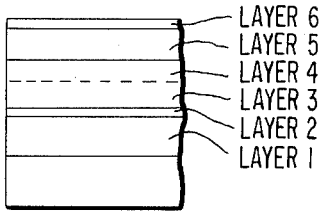

In FIG. 5, the first layer represents a BL, the second layer an FL (magenta), the third layer a first GL, the fourth layer a second GL, the fifth layer an RL and the sixth layer a PL. The first GL contains a magenta coupler, and the second GL contains an ICC uncolored coupler and a magenta coupler.

U.S. Pat. No. 3,620,745 describes a two-layered light-sensitive material using a "DIR coupler". However, the multi-layered structure of the present invention is essentially different from that. Firstly, the present invention relates to markedly realizing a "color-correcting effect" in a system of a multi-layered color photographic light-sensitive material wherein silver halide emulsions having substantially the same developing rate are used. Secondly, the silver halide emulsion of the layer in which the DIR coupler is used is not limited to a silver halide emulsion of finer grains or a chlorobromide emulsion.

The multi-layered structure of the present invention is also essentially different from the direct-positive light-sensitive material according to the diffusion transfer method, described in U.S. Pat. No. 3,227,551. Firstly, with the known material, a silver halide emulsion layer containing a DIR coupler is in contact with a fogged light-insensitive emulsion layer containing the DIR coupler. Secondly, the DIR coupler is used along or in an overwhelmingly high ratio and the light-sensitive emulsion itself containing the coupler is not designed to form color images.

German Patent OLS No. 2,322,165 describes a method of using a so-called DIR coupler in a multi-layered structure color recording material. However, while the present invention relates to an improvement in color reproducibility based on the effects on the adjacent light-sensitive emulsion layer unit, the invention described in German Pat. OLS No. 2,322,165 relates to an improvement in the images by the DIR effects in the layer containing this coupler, such as graininess or the sharpness of images. The tendency of DIR effects provided by couplers are different between that occurring between layers such as an interlayer color-correcting effect and that occurring within the layer containing the coupler such as improvement of graininess and sharpness. Therefore, the present invention is distinguished from the element described in German Patent OLS No. 2,322,165.

In the multi-layered structure of the present invention at least one light-sensitive silver halide emulsion layer unit constituting the color light-sensitive material is comprised of two or more unit layers, with at least one of these unit layers containing an ICC uncolored coupler. It is desirable that the silver halide emulsion layers constituting these unit layers possess different sensitometry gamma values from each other, e.g., a sensitometry gamma value difference achieved where at least one of them possesses different sensitometry gamma value from that of the remainder.

The sensitometry gamma value referred to in the present invention means the maximum value of the slope of a photographic characteristic curve (H&D curve) and, in many cases, it is the slope at the linear slope area of the characteristic curve. Unit layers constituting the emulsion layer unit of the present invention have intrinsic sensitometry gamma values different from each other by at least 0.1, preferably by 0.2. It is preferable to incorporate the ICC uncolored coupler in an emulsion unit layer having the higher gamma value. Because, firstly, effective interlayer effects can be obtained, for the entire emulsion layer unit, by using only a small amount of ICC coupler. Secondly, a fine grained color image is easily formed at the emulsion layer unit. Thirdly, excellent tone tends to be obtained with little change in gradation from the initial stage to the final stage of development.

These unit layers possess intrinsic sensitometry gamma values different from each other or at least one of them possesses a different sensitometry gamma value from the remainder by at least 0.1, preferably not less than 0.2. If the difference in the gamma value of the emulsions is less than 0.1, a disadvantage in designing light-sensitive materials occurs in that the degree of freedom in the combination of silver halide emulsions is reduced. On the other hand, even if the sensitometry gamma values are different by more than 0.2 between the unit layers, no disadvantages at all occur in designing color light-sensitive materials and is preferable on the contrary.

On the other hand, it is preferable in designing color light-sensitive materials that one of two or more unit layers constituting a light-sensitive silver halide emulsion layer unit contain silver halide having a lower mean grain size and the other layer or layers contain silver halide having a larger mean grain size. That is, by adroitly combining, in two or more unit layers constituting an emulsion layer unit, a unit layer of a silver halide emulsion having a lower mean grain size and a unit layer of a silver halide emulsion having a larger mean grain size, maintenance of the maximum optical density at a high level, enlargement of the latitude, making the grain small, obtaining a linear gradation property, obtaining excellent color-correcting effects can be facilitated by adroitly combining the adjustment of the masking effect and the interlayer color-correcting effect of the ICC uncolored coupler, and the like, due to the mutual action between the unit layers upon development.

In the present photographic art where photographic light-sensitive materials tend to be made finer and more sensitive, the art of utilizing fine-grained silver halide emulsions is of importance. As is stated above, conventional well known DIR couplers as described in U.S. Pat. 3,227,554 bring about interlayer effects with difficulty and almost no interlayer effects on fine-grained silver halide emulsions are shown. On the other hand, the ICC uncolored couplers of the present invention exert sufficient interlayer effects even on fine-grained silver halide emulsions.

The mean grain size of silver halide grains in one silver halide emulsion unit layer, of the two units layers, containing relatively finer grains ranges from about 0.04 to 0.7$\mu$, preferably 0.1 to 0.6$\mu$, whereas the mean grain size of silver halide grains contained in the other silver halide emulsion unit containing relatively coarser grains ranges from about 0.3 to 2$\mu$, preferably 0.5 to 1.5$\mu$.

The difference in the mean grain size of silver halide emulsion between both unit layers is 0.01, preferably 0.; to 1.5$\mu$, more preferably 0.2 to 1.0$\mu$.

The couplers of the present invention can be roughly classified into two groups: one group being Fischer type couplers having a water-soluble group such as a carboxy group, a hydroxy group, a sulfo group, etc.; and the other group being hydrophobic couplers.

As a method for the addition or the dispersion of the couplers in an emulsion or in a gelatino silver halide emulsion or a hydrophilic colloid, those conventionally known methods in the art can be employed. For example, a method of mixing the coupler with a high boiling organic solvent, (e.g., having a boiling point higher than 175° C) such as dibutyl phthalate, tricresyl phosphate, a wax, a higher fatty acid, or an ester thereof for dispersion (as described in, e.g., U.S. Pat. Nos. 2,269,158; 2,272,191; 2,304,939; 2,322,027; etc.), a method of mixing the coupler with a low boiling organic solvent (e.g., having a boiling point lower than 175° C) or a water-soluble organic solvent for dispersion, a method of dispersing the coupler using a high boiling solvent (e.g., having a boiling point higher than 175° C) in combination with a low boiling organic solvent or a water-soluble organic solvent (as described in, e.g., U.S. Pat. No. 2,801,170; 2,801,171; 2,949,360; etc.) and, when the coupler itself has a sufficiently low melting point (for example, less than 75° C), a method of dispersing the coupler alone or in combination with the other couplers used in combination, such as a colored coupler or an uncolored coupler (described in, e.g., German Pat. No. 1,143,707, etc.), and a method of dispersing the coupler using in combination an oleophilic synthetic polymer such as a copolymer of butyl methacrylate and hydroxyethyl acrylate can be employed. The coupler is used preferably in an amount of about 0.2 mol to 0.01 mol per mol of silver halide. The ICC uncolored coupler of the present invention is used together preferably in an amount of about 50 mol% to 1 mol% based on the coupler.

As dispersing aids, conventionally used anionic surface active agents (e.g., sodium alkylbenzenesulfonate, sodium dioctylsulfosuccinate, sodium dodecylsulfate, sodium alkylnaphthalenesulfonate, Fischer type couplers, etc.), amphoteric surface active agents (e.g., N-tetradecyl-N,N-dipolyethylene-$\alpha$-betaine, etc.), and nonionic surface active agents (e.g., sorbitan monolaurate, etc.) can be used.

As the silver halide emulsion which can be used in the present invention, photographic emulsions comprising a silver halide such as silver bromide, silver iodide, silver chloride or a mixture thereof (i.e., silver chlorobromide, silver bromoiodide, silver chlorobromoiodide) can be used. In particular, good results can be obtained when at least one photographic emulsion layer contains about 1 to 10 mol% silver chloroiodide, silver bromoiodide or silver chlorobromoiodide. The silver halide grains used in the present invention possess a mean grain size of about 0.04 to 2$\mu$. The mean grain size is measured according to a method described in, e.g., Trivelli & Smith, Photographic Journal, vol. 74, pp. 330 – 338 (1939), U.S. Pat. Nos. 3,501,305; 3,501,310; etc.

The silver halide particles in the silver halide emulsion can be in the cubic system, octahedral system, dodecahedral system, and mixtures of these systems. In particular, it is preferred that the smaller silver halide particles have a (100) face or a (111) face, and that the larger silver halide particles be plate like or have a (111) face. For the higher sensitive unit layer of the emulsion layer unit, an emulsion which contains silver halide particles of a (111) face (or plate like) is preferred. And for the lower sensitive unit layer, an emulsion which contains silver halide particles of the cubic system, the dodecahedral system of a (100) face is preferred.

Thus, for each unit layer of the emulsion layer unit, on considering the diameter or the surface of the silver halide particles, the developing activity of the surface of silver halide, and the adsorption activity of inhibiting agents, a suitable sensitive material which gives an interimage effect between each light-sensitive emulsion layer unit can be chosen.

The silver halide particles can be produced using the single jet method, the double jet method, the controlled double jet process or any other well known methods. Suitable methods are disclosed in C. E. K. Mees and T. H. James, The Theory of the Photographic Process, MacMillan Press, New York, P. Glafkides, Chimie Photographic, Paul Montel Press, Paris, U.S. Pat. No. 3,622,318 and British Pat. No. 635,841.

Suitable hydrophilic colloids which can be used include gelatin, cellulose derivatives, alginates, hydrophilic synthetic polymers (e.g., polyvinyl alcohol, polyvinyl pyrrolidone, polystyrenesulfonic acid, etc.), and the like. Furthermore, a plasticizer for improving the dimensional stability of films and a polymer latex such as polymethyl methacrylate, polyethyl acrylate, etc. can be used.

Suitable examples of polymers which can be used are disclosed in U.S. Pat. Nos. 2,376,005; 2,739,137;

2,853,457; 3,062,674; 3,411,911; 3,488,708; 3,525,620; 3,635,715; 3,607,290; and 3,645,740; British Pat. Nos. 1,186,699; and 1,307,373. In particular, it is preferred that the polymers be present during the process of precipitation and growth of the silver halide particles.

To the silver halide emulsion used in the present invention can be applied conventionally employed chemical sensitization methods, e.g., a gold sensitization method as described in U.S. Pat. Nos. 2,399,083; 2,597,856; and 2,597,915; a reduction sensitization method as described in U.S. Pat. Nos. 2,487,850 and 2,521,925, a sulfur sensitization method as described in U.S. Pat. Nos. 1,623,499 and 2,410,689, a sensitization method using different metal ions as described in U.S. Pat. Nos. 2,448,060; 2,566,245 and 2,566,263, or a combination of these methods.

In addition, the silver halide photographic emulsion used in the present invention can be color-sensitized using in combination a conventional sensitizing dye such as anhydro-9-methyl-5,5'-dimethyl-3,3'-di(3-sulfopropyl)-benzoselenacarbocyanine, 5,5'-dichloro-9-ethyl-di(2-hydroxyethyl)thiocarbocyanine bromide, anhydro-5,5'-diphenyl-9-ethyl-3,3'-di(2-sulfoethyl)-benzoxazolocarbocyanine hydroxide or the like and a sensitizing dye used for the spectral sensitization of color light-sensitive materials alone or in combination.

Furthermore, a conventionally used stabilizer (e.g., 4-hydroxy-1,3,3a,7-tetrazaindene derivative, etc.), an anti-fogging agent (e.g., a mercapto compound, a benzotriazole derivative, etc.), a coating aid (e.g., saponin, a sodium alkylbenzenesulfonate, etc.), a hardening agent (e.g., formaldehyde, mucobromic acid, etc.), a wetting agent, a sensitizing agent (e.g., an onium derivative such as a quaternary ammonium salt as described in U.S. Pat. Nos. 2,271,623; 2,288,226; and 2,334,864) and a polyalkylene oxide derivative as described in U.S. Pat. Nos. 2,708,162; 2,531,832; 2,533,990; 3,210,191; 3,158,484; etc. Also, dyes for anti-irradiation and, as a constituent for the stratum of the color light-sensitive material of the present invention, a filter layer, a mordant dye layer or a hydrophobic dye-containing colored layer can be present.

The light-sensitive emulsion used in the present invention can be applied to various supports. Suitable such supports are, e.g., cellulose acetate films, polyethylene terephthalate films, polyethylene films, polypropylene films, glass plates, baryta papers, resin-laminated papers, synthetic papers, and the like.

The stratum structure of the present invention is useful for a method of providing color images, i.e., for any method of forming color images having different colors in proportion to the ratio of silver halide being reduced to silver by development-processing a multi-layered color light-sensitive material containing at least two light-sensitive emulsion layers containing a silver halide and a coupler or couplers dispersed in a hydrophilic colloid medium. For example, the combination of the present invention is useful for reversal color photography, i.e., for obtaining positive color images by imagewise exposing a multi-layered color photographic material having at least two silver halide photographic emulsion layers sensitized to different wavelength regions, developing in a black-and-white developer to obtain a negative silver image, then color-developing silver halide emulsion grains in the areas not developed with the black-and-white developer to thereby obtain a color image.

Also, the stratum structure of the present invention is useful for forming a negative color image by imagewise exposing a multi-layered color light-sensitive material having at least two silver halide emulsion layers sensitized to different wavelength regions and containing diffusion-resistant couplers, then color-developing directly.

For the color photographic light-sensitive materials of the present invention can be used, in the processing step of forming color images, a developer capable of reducing silver halide grains to silver. In the case of black-and-white development, a developer containing as a developing agent a polyhydroxybenzene, an N-alkylaminophenol, a 1-phenyl-3-pyrazolidone or a mixture thereof can be used. As the polyhydroxybenzene, there are illustrated, e.g., hydroquinone, pyrocatechol, pyrogallol, etc. As the N-alkylaminophenol, there are illustrated, e.g., N-methylaminophenol, N-ethylaminophenol, etc. As the 1-phenyl-3-pyrazolidone, there are illustrated, e.g., 1-phenyl-3-pyrazolidone, 1-phenyl-4,4-dimethyl-3-pyrazolidone, etc. In the case of color development, a developer containing as a developing agent a p-phenylenediamine derivative such as 4-amino-N,N-diethylaniline, 4-amino-3-methyl-N-methyl-N-(β-methylsulfonamidoethyl)aniline, 4-amino-3-methyl-N-ethyl-N-(β-hydroxyethyl)aniline, 4-hydroxyaniline, 4-hydroxy-2,6-dibromoaniline, etc. can be used.

The multi-layered color photographic light-sensitive material of the present invention can be processed at conventionally employed temperatures, e.g., about 20° to 30° C. In addition the material of the present invention can be processed at higher temperatures, i.e., about 30° to 60° C or higher.

The processing steps suitable for processing the multi-layered color light-sensitive material of the present invention are described in, e.g., Japanese Patent Publication No. 35749/70, Japenese Patent Application Nos. 67798/69, 13313/71, 19516/71 and German Patent OLS No. 2,238,051 and in H. Gordon, The British Journal of Photography, Nov. 15th, 1954, p. 558 et seq; ibid, Jan. 6th, 1956, p. 2 et seq; S. Horwitz, ibid, Apr. 22nd, 1960, p. 212 et seq; E. Gehret, ibid, Mar. 4th, 1960, p. 122 et seq; ibid, May, 7th, 1965, p. 396 et seq; and J. Meech, ibid. Apr. 3rd, 1959, p. 182 et seq.

The following are illustrative of the effects and advantages attained by the present invention. For example, color light-sensitive materials having excellent color reproducibility can be obtained by using a small amount of an ICC uncolored coupler. Color photographic light-sensitive materials having strengthened color-correcting effects without a deterioration of the gradation (gamma) of the ICC uncolored coupler-containing silver halide emulsion layer itself and without a reduction in the Dmax and effective sensitivity can be obtained. Also, color photographic light-sensitive materials providing improved graininess and sharpness of color images and having strengthened color-correcting effects can be obtained. Color negative photographic light-sensitive materials capable of providing color images having improved graininess, excellent gradation and strengthened color-correcting effects without reduction in sensitivity can be obtained by adroitly combining an ICC uncolored coupler, and a colored coupler. A highly sensitive fine-grained color light-sensitive material having excellent color reproducibility can be obtained.

The present invention will now be illustrated in greater detail by reference to the following non-limiting examples of preferred embodiments of the present invention. Unless otherwise indicated, all parts, percents, ratios and the like are by weight.

EXAMPLE 1

Figure 6:
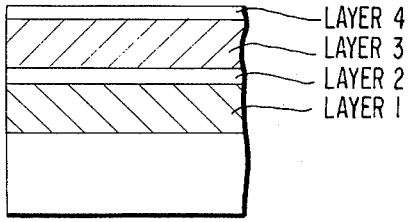

Sample A was prepared by coating on a transparent cellulose triacetate film support a first layer (red-sensitive emulsion layer), a second layer (intermediate layer), a third layer (green-sensitive emulsion layer) and a fourth layer (protective layer) in turn as shown in FIG. 6. The composition and the process for the preparation of each coating solution were as follows.

First Layer:

1 kg of silver bromoiodide emulsion (silver content: 0.6 mol; iodide content: 6 mol%; mean grain size: 0.87 micron; intrinsic cyan gamma value: 0.85) prepared in a common manner was removed and was spectrally sensitized using $4 \times 10^{116\ 5}$ mol of Sensitizing Dye I (described hereinafter) and $1 \times 10^{-5}$ mol of Sensitizing Dye II (described hereinafter). Separately, 100 g of Coupler (13) was dissolved in a mixture of 100 cc of tricresyl phosphate and 200 cc of ethyl acetate, and emulsified and dispersed in 1 kg of a 10% gelatin solution using 4 g of sodium nonylbenzenesulfonate, 450 g of the thus obtained Emulsion I was added to the above-described spectrally sensitized emulsion. Further, 0.1 g of 2,4-dichloro-6-hydroxy-s-triazine sodium salt was added thereto as an aqueous solution.

Second Layer:

50 g of 2,5-di-tert-octylhydroquinone and 10 g of 2-(1-phenyltetrazol-5-ylthio)-5-n-octadecylthiohydroquinone were dissolved in 100 cc of tricresyl phosphate, then dispersed in 1 kg of a 10% gelatin aqueous solution in the same manner as in Emulsion I. 250 g of the resulting emulsion was added to 1 kg of a 10% gelatin aqueous solution.

Third Layer:

1 kg of a silver bromoiodide emulsion (the same as in the first layer; intrinsic magenta gamma being 0.85) was spectrally sensitized using $2 \times 10^{-4}$ mol of Sensitizing Dye III (described hereinafter) and $6 \times 10^{-5}$ mol of Sensitizing Dye IV (described hereinafter). 100 g of Coupler (7) was emulsified and dispersed in the same manner as in Emulsion I to obtain Emulsion II. 600 g of the resulting Emulsion II was added to the above-described emulsion to obtain a coating solution in the same manner as with the first layer Fourth Layer:

0.2 g of sodium nonylbenzenesulfonate was added to 1 kg of a 10% gelatin aqueous solution.

Sensitizing Dye I: Anhydro-5,5′-dichloro-3,3′-disulfopropyl-9-ethylthiocarbocyanine hydroxide pyridinium salt Sensitizing Dye II: Anhydro-9-ethyl-3,3′-di-(3-sulfopropyl)4,5,4′,5′-dibenzothiocarbocyanine hydroxide triethylamine salt Sensitizing Dye III: Anhydro-9-ethyl-5,5′-dichloro-3,3′-disulfopropyloxocarbocyanine sodium salt Sensitizing Dye IV: Anhydro-5,6,5′,6′-tetrachloro-1,1′-diethyl-3,3′-disulfopropoxyethoxyethylimidazolocarbocyanine hydroxide sodium salt The procedures described for Sample A were conducted except for using a mixture of Coupler (7) and ICC Uncolored Coupler (20) (4:1 in molar ratio) in lieu of Coupler (7) in Emulsion II to obtain Emulsion III. Sample B was obtained in the same manner as Sample A, using Emulsion III in place of Emulsion II.

Figure 7:
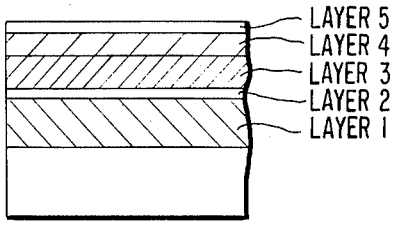

Furthermore, as is shown in FIG. 7, Sample C was prepared in which the third layer in Sample A comprised two layers, third A layer and third B layer. In this case, a coating solution for the third A layer (first green-sensitive layer) was prepared in the same manner as in the third layer of Sample A except for adding 900 g of Emulsion IV (described hereinafter) to 1 kg of a silver bromide emulsion (silver content: 0.6 mol; iodide content: 6 mol%; mean grain size: 0.35 micron; inrinsic magenta gamma value: 1.20; sensitivity: about 1/10 that of the silver bromoiodide emulsion used for the third B layer). Emulsion IV used was prepared in the same manner as in Emulsion III using a mixture of Coupler (7) and ICC Uncolored Coupler (20) (5.5:2 in molar ratio).

The third B layer (second green-sensitive emulsion layer) was formed in the same manner as in the third layer of Sample A except for adding 300 g of Emulsion II to 1 kg of a silver bromoiodide emulsion (same as used in the third layer of Sample A). The coated silver content and the coupler content in Sample C were adjusted so that they were about the same, in the total thereof in the third A layer and third B layer, as that of the third layer of Sample A or Sample B.

Samples A, B and C were stepwise exposed using a green light followed by uniform exposure to red light. Then, they were development-processed at 38° C according to the following sequence of steps.

| | | |
|---|---|---|
| 1. | Color Development | 3 min and 15 sec |
| 2. | Bleaching | 6 min and 30 sec |
| 3. | Washing | 3 min and 15 sec |
| 4. | Fixing | 6 min and 30 sec |
| 5. | Washing | 3 min and 15 sec |
| 6. | Stabilizing | 3 min and 15 sec |

The compositions of the processing solutions used in the respective steps were as follows.

| | | |
|---|---|---|
| Color Developer: | | |
| Sodium Nitrilotriacetate | 1.0 | g |
| Sodium Sulfite | 4.0 | g |
| Sodium Carbonate | 30.0 | g |
| Sodium Bromide | 1.4 | g |
| Hydroxylamine Sulfate | 2.4 | g |
| 4-(N-Ethyl-N-β-hydroxyethylamino)-2-methylaniline Sulfate | 4.5 | g |
| Water to make | 1 | l |
| Bleaching Solution: | | |
| Ammonium Bromide | 160.0 | g |
| Aqueous Ammonia (28%) | 25.0 | ml |
| Sodium Iron Ethylenediamine-tetraacetate | 130.0 g | |
| Glacial Acetic Acid | 14.0 | ml |
| Water to make | 1 | l |
| Fixing Solution: | | |
| Sodium Tetrapolyphosphate | 2.0 | g |
| Sodium Sulfite | 4.0 | g |
| Ammonium Thiosulfate (70%) | 175.0 | g |
| Sodium Bisulfite | 4.6 | g |
| Water to make | 1 | l |
| Stabilizing Solution: | | |
| Formalin (40%) | 8.0 | ml |
| Water to make | 1 | l |

The red light transmission density and the green light transmission density of the thus developed Samples A, B and C were measured for comparison. The results of the measurement with Sample A are shown in FIG. 9, the results with Sample B in FIG. 10, and the results with Sample C in FIG. 11. In FIGS. 9 to 11, the dotted lines represent the red light density, and the solid lines represent the green light density.

With Sample A, the green light density increased with an increase in the exposure amount of green light while the red light density was almost constant. Thus, the interimage effect of the green-sensitive layer on the red-sensitive layer was scarcely observed. On the other hand, with Samples B and C, although the green light density increased with an increase in the exposure amount of green light similar to Sample A, the red light density was reduced. This tendency was more conspicuous in Sample A. Thus, the interimage effect of the green sensitive layer on the red-sensitive layer was found to be quite high. This fact shows that Coupler 20 of the present invention contained in the third layer and third A layer of Samples B and C sufficiently functions as a coupler which releases a restrainer in proportion to the degree of development.

In addition, a comparison of curves (the full lines) showing the green light transmission density given in FIGS. 9 to 11 reveals that, while Sample B was lower than Sample A in the Dmax of the magenta color image, Sample C not only possessed a high Dmax of the magenta color image but also possessed excellent gradation and high sensitivity over a broader exposure region.

Additionally, the combined use of a colored coupler, e.g., Coupler (9), in the third B layer of Sample C provided effective color-correcting effects on the undesired absorption of the magenta image on the shorter wave-length side.

EXAMPLE 2

Figure 8:
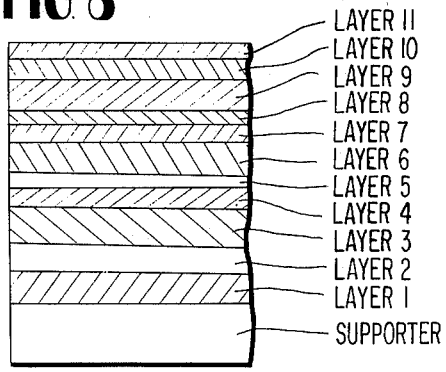

A multi-layered color light-sensitive material, Sample D, comprising a transparent cellulose triacetate film support having provided thereon layers having the following composition as shown in FIG. 8, was prepared.

First Layer (Anti-halation Layer):

A gelatin layer containing black colloidal silver was coated in a thickness of about 1.5$\mu$ to provide 0.45 g/m$^2$ of silver.

Second Layer (Intermediate Layer):

A gelatin layer containing 2,5-di-tert-octylhydroquinone which is emulsified and dispersed therein was coated in a dry thickness of about 0.7$\mu$ to provide a coverage of $1.6 \times 10^{-4}$ mol/m$^2$ of the 2,5-di-t-octylhydroquinone.

Third Layer (First Red-Sensitive Emulsion Layer):

Silver bromoiodide emulsion (iodide content: 8 mol%; intrinsic cyan gamma value: 1.10; mean grain size: 0.4$\mu$), coated in a silver amount of 1.2 g/m$^2$.

| | |
|---|---|
| Sensitizing Dye I (described in Example 1) | $6 \times 10^{-5}$ mol/mol silver |
| Sensitizing Dye II (described in Example 1) | $1.5 \times 10^{-5}$ mol/mol silver |
| Coupler (13) | 0.09 mol/mol silver |
| Colored Coupler (14) | 0.02 mol/mol silver |

Fourth Layer (Second Red-Sensitive Emulsion Layer):

Silver bromoiodide emulsion (iodide content: 8 mol%; intrinsic cyan gamma value: 0.43; mean grain size: 0.8$\mu$), coated in a silver amount of 1.1 g/m$^2$.

| | |
|---|---|
| Sensitizing Dye I | $3 \times 10^{-5}$ mol/mol silver |
| Sensitizing Dye II | $1.2 \times 10^{-5}$ mol/mol silver |
| Coupler (21) | 0.02 mol/mol silver |
| Coupler (13) | 0.04 mol/mol silver |

Fifth Layer (Intermediate Layer):

A gelatin layer containing a 2,5-di-tert-octylhydroquinone emulsion dispersion was coated in a dry thickness of about 1.2$\mu$ to provide $2.7 \times 10^{-4}$ mol/m$^2$ of 2,5-di-t-octylhydroquinone.

Sixth Layer (First Green-Sensitive Emulsion Layer):

Silver bromoiodide emulsion (iodide content: 6 mol%; intrinsic magenta gamma value: 0.50; mean grain size: 0.8$\mu$), coated in a silver amount of 1.5 g/m$^2$.

| | |
|---|---|
| Sensitizing Dye III (shown in Example 1) | $3 \times 10^{-5}$ mol/mol silver |
| Sensitizing Dye IV (shown in Example 1) | $1 \times 10^{-5}$ mol/mol silver |
| Coupler (7) | 0.06 mol/mol silver |

Seventh Layer (Second Green-Sensitive Emulsion Layer):

Silver bromoiodide emulsion (iodide content: 4 mol%; intrinsic magenta gamma value: 1.15; mean grain size: 0.6$\mu$), coated in a silver amount of 1.7 g/m$^2$.

| | |
|---|---|
| Sensitizing Dye III | $2.5 \times 10^{-5}$ mol/mol silver |
| Sensitizing Dye IV | $0.8 \times 10^{-5}$ mol/mol silver |
| Coupler (7) | 0.004 mol/mol silver |
| Coupler (9) | 0.013 mol/mol silver |

Eighth Layer (Yellow Filter Layer):

A gelatin layer containing yellow colloidal silver and 2,5-di-tert-octylhydroquinone emulsion dispersion was coated in a dry thickness of about 1.5$\mu$ to provide a coverage of 1.01 g of silver/m$^2$ and $4.4 \times 10^{-4}$ mol of 2,5-di-tert-octylhydroquinone/m$^2$.

Ninth Layer (First Blue-Sensitive Emulsion Layer):

Silver bromoiodide emulsion (iodide content: 7 mol%; intrinsic yellow gamma value: 1.10; mean grain size: 0.4$\mu$), coated in a silver amount of 1 g/m$^2$.

| | |
|---|---|
| Coupler (4) | 0.25 mol/mol silver |

Tenth Layer (Second Blue-Sensitive Emulsion Layer):

Silver bromoiodide emulsion (iodide content: 6 mol%; intrinsic yellow gamma value: 0.45; mean grain size: 0.8$\mu$), coated in a silver amount of 1.1 g/m$^2$.

| | |
|---|---|
| Coupler (4) | 0.07 mol/mol silver |

Eleventh Layer (Protective Layer):

A gelatin layer containing polymethyl methacrylate particles (diameter: about 1.5 microns) and Lippmann type silver halide grains (grain size: 0.06 micron).

To each of the above-described layers were additionally added a gelatin-hardening agent, a coating aid (surface active agent), and a thickening agent.

In the same manner as described for Sample D except for using the following couplers in the sixth layer, Sample E having a similar structure to that of Sample D was prepared.

| | |
|---|---|
| Coupler (10) | 0.035 mol/mol silver |
| Coupler (20) | 0.025 mol/mol silver |

Samples D and E were formed into 35 mm-color negative light-sensitive materials and subjected to photography using a still camera. Then, they were color development-processed according to the steps described in Example 1 to obtain color negatives.

The color purity, graininess and sharpness of the color negative obtained from Sample E were far more excellent than those of the color negative obtained from Sample D. This is because the coupler of the present invention used in the sixth layer imagewise releases a restrainer upon color development, which serves to improve the graininess and sharpness of the magenta layer and exerts interimage effects on the other layers as described in Example 1 with barely any deterioration of gradation, Dmax and sensitivity of the magenta layer, thus improving color reproducibility.

Similarly good results were obtained by appropriately using couplers selected from yellow couplers, magenta couplers, cyan couplers (including colored couplers) and color-correcting uncolored couplers, illustrated as specific examples of the couplers, in lieu of each coupler used in Example 2.

In the Examples, it is possible to separate the light-sensitive emulsion layers, which are to be colored substantially the same color, into a plurality of unit layers or change the application order of the light-sensitive emulsion layers, which are to be colored different colors, depending on the end-use purpose. Also, the use and the amount of couplers, the hydroquinone derivatives or like substances, or the layer in which they are incorporated can be optionally altered by those skilled in the art based on the present invention depending upon the end-use purpose.

The present invention can of course be applied to color negative light-sensitive materials, color reversal light-sensitive materials, color print light-sensitive materials, color transparent positive light-sensitive materials and color papers. In addition, it can be applied to color photographic light-sensitive materials of the direct positive system (using either an emulsion fogged before imagewise exposure or an emulsion fogged after or substantially simultaneously with imagewise exposure).

While the invention has been described in detail and with reference to specific embodiments thereof, it will be apparent to one skilled in the art that various changes and modifications can be made therein without departing from the spirit and scope thereof.

What is claimed is:

1. An incorporated-coupler multi-layered color photographic light-sensitive material which comprises a support having thereon at least two light-sensitive emulsion layer units which provide, upon color development, images having substantially different hues, at least one of said light-sensitive emulsion layer units comprising two or more silver halide unit layers and at least one of said unit layers contains an interlayer color correction uncolored coupler alone or in combination with another coupler, and said interlayer color correction uncolored coupler is an uncolored magenta interlayer color correction coupler of the general formula (Ia):

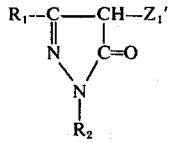

(Ia)

wherein $R_1$ represents a primary, secondary or tertiary alkyl group, an alkoxy group, an aryl group, an aryloxy group, a heterocyclic group, an amino group, a carbonamido group or a ureido group; $R_2$ represents an aryl group or a heterocyclic group; and $Z_1'$ represents a heterocyclic imino group represented by the following general formula;

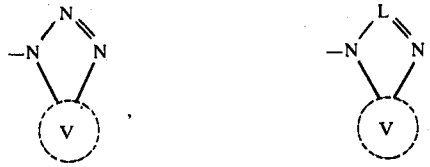

or

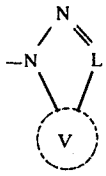

wherein V represents an aromatic ring of the benzene series or a heteroaromatic ring containing at least one nitrogen atom, L represents a methine group or a derivative thereof, and V can be substituted with an amino group, an acylamino group, a halogen atom, an alkyl group, a nitro group, an alkoxy group, an alkylthio group, an arylthio group or an aryl group which, upon color development, is rapidly released and functions as a development restrainer;

an interlayer color correction uncolored yellow coupler of the general formula (IIa):

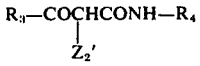

(IIa)

wherein $R_3$ represents a primary, secondary or tertiary alkyl group having 1 to 18 carbon atoms or an aryl group; $R_4$ represents an aryl group; and $Z_2'$ represents a heterocyclic imino group represented by the following general formula:

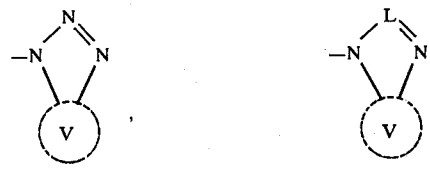

or

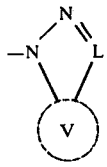

wherein V represents an aromatic ring of the benzene series or a heteroaromatic ring containing at least one nitrogen atom, L represents a methine group or a derivative thereof, and V can be substituted with an amino group, an acylamino group, a halogen atom, an alkyl group, a nitro group, an alkoxy group, an alkylthio group, an arylthio group or an aryl group which, upon color development, is rapidly released and functions as a development restrainer;

an interlayer color correction uncolored cyan coupler of the general formula (III*a*) or (IV*a*):

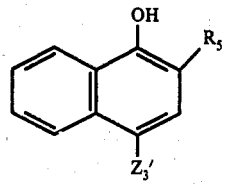

(IIIa)

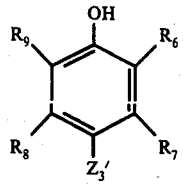

(IVa)

wherein $R_5$ represents a carbamyl group, a sulfamyl group, an alkoxycarbonyl group or an aryloxycarbonyl group; $R_6$ represents an alkyl group, an aryl group, a heterocyclic group, an amino group, a carbonamido group, a sulfonamido group, a sulfamyl group or a carbamyl group; $R_7$, $R_8$ and $R_9$ each represents a halogen atom, an alkoxy group, an alkyl group, an aryl group, a heterocyclic group, an amino group, a carbonamido group, a sulfonamido group, a sulfamyl group or a carbamyl group; and $Z_3'$ represents an iodine atom or a heterocyclic imino group represented by the following general formula;

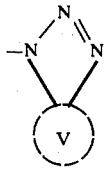

,

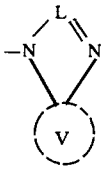

or

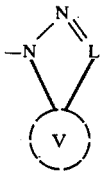

wherein V represents an aromatic ring of the benzene series or a heteroaromatic ring containing at least one nitrogen atom, L represents a methine group or a derivative thereof, and V can be substituted with an amino group, an acylamino group, a halogen atom, an alkyl group, a nitro group, an alkoxy group, an alkylthio group, an arylthio group or an aryl group which, upon color development, is released and functions as a development restrainer.

2. The incorporated-coupler multi-layered color photographic light-sensitive material of claim 1 which comprises a support having thereon at least two silver halide light-sensitive emulsion layer units capable of providing images having substantially different hues upon color development, at least one of said light-sensitive emulsion layer units comprising two or more unit layers in which the sensitometry gamma values of said layers are different from each other or the sensitometry gamma value of at least one of which layers is different from the value of the other layers, and at least one of which unit layers contains said interlayer color correction uncolored coupler alone or in combination with another coupler.

3. The incorporated-coupler multi-layered color photographic light-sensitive material of claim 1 which comprises a support having provided thereon at least two silver halide light-sensitive emulsion layer units capable of providing images having substantially different hues upon color development, at least one of said light-sensitive emulsion layer units comprising two or more unit layers in which the sensitometry gamma values of which layers are different from each other or the sensitometry gamma value of at least one of which layers is different from the value of the other layers, and said interlayer color correction uncolored coupler incorporated alone or in combination with another coupler in the unit layer comprising a silver halide emulsion having a relatively higher gamma value.

4. The incorporated-coupler multi-layered color photographic light-sensitive material of claim 1 which comprises a support having provided thereon at least two silver halide emulsion layer units capable of providing images having substantially different hues upon color development, at least one of said light-sensitive emulsion layer units comprising two or more unit layers comprising silver halide emulsions which are equal or different in mean grain size of the silver halide particles contained therein, and at least one of which unit layers contains said interlayer color correction uncolored coupler alone or in combination with one or more couplers.

5. The incorporated-coupler multi-layered color photographic light-sensitive material according to claim 4, in which said ICC uncolored coupler is incorporated alone or in combination with another coupler in the unit layer comprising a silver halide emulsion having a relatively smaller mean grain size silver halide grains among said unit layers.

6. The incorporated-coupler multi-layered color photographic light-sensitive material according to claim 1, in which said light-sensitive material comprises a support having provided thereon a red-sensitive silver halide light-sensitive emulsion layer unit containing a diffusion-resistant cyan coupler which, upon color development, provides a cyan image, a green-sensitive silver halide light-sensitive emulsion layer unit containing a diffusion-resistant magenta coupler which, upon color development, provides a magenta image, and a blue-sensitive silver halide light-sensitive emulsion layer unit containing a diffusion-resistant yellow coupler which, upon color development, provides a yellow image, at least one of said light-sensitive emulsion layer units comprising two or more silver halide emulsions having different sensitometry gamma values from each other and, 1. at least one of said interlayer color correction couplers being incorporated alone or in combination with another coupler in the unit layer containing a silver halide emulsion having a smaller mean grain size and a relatively higher gamma value, and
2. at least one DIR coupler being incorporated alone or in combination with another coupler in the unit layer containing a silver halide emulsion having a greater mean grain size and a relatively lower gamma value.

7. The incorporated-coupler multi-layered color photographic light-sensitive material according to claim 1, in which said heterocyclic imino group has the general formula

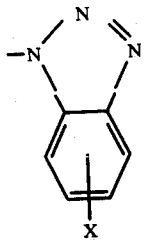

wherein X represents a hydrogen atom, a halogen atom, an alkyl group or the atoms necessary to form a naphthalene ring together with the benzene ring.

8. The incorporated-coupler multi-layered color photographic light-sensitive material according to claim 2, in which at least one of said light-sensitive emulsion layer units comprises two or more silver halide emulsion unit layers, the sensitometry gamma values of which are different from each other or the sensitometry gamma value of at least one of which is different from the values of the other layers by not less than 0.1.

9. The incorporated-coupler multi-layered color photographic light-sensitive material according to claim 2, in which at least one of said light-sensitive emulsion layer units comprises two or more silver halide emulsion unit layers the sensitometry gamma values of which are different from each other or the sensitometry gamma value of at least one of which is different from the values of the other layers by not less than 0.2.

10. The incorporated-coupler multi-layered color photographic light-sensitive material according to claim 4, in which at least one of said light-sensitive emulsion layer units comprises two or more silver halide emulsion unit layers which are different from each other in silver halide mean grain size by 0.01 to 2$\mu$.

11. The incorporated coupler multi-layered color photographic light-sensitive material according to claim 4, in which at least one of said light-sensitive emulsion layer units comprises two or more silver halide emulsion unit layers which are different from each other in silver halide mean grain size by 0.2 to 1.0$\mu$.

12. The incorporated coupler multi-layered color photographic light-sensitive material according to claim 4, in which at least one of said light-sensitive emulsion layer units comprises two or more unit layers comprising silver halide emulsions equal or different from each other in the mean grain size of the silver halide grains, the mean grain size of the smaller silver halide grains contained in the unit layer being 0.04 to 0.7$\mu$ and the mean grain size of the larger silver halide grains contained in the other unit layer being 0.3 to 2$\mu$ with the difference between these two silver halide emulsions in mean grain size being 0.01 to 2$\mu$.

13. The incorporated-coupler multi-layered color photographic light-sensitive material according to claim 4, in which at least one of said light-sensitive emulsion layer units comprises two or more unit layers comprising silver halide emulsions equal or different from each other in the mean grain size of the silver halide grains, the mean grain size of the smaller silver halide grains contained in the unit layer being 0.04 to 0.6$\mu$ and the mean grain size of the larger silver halide grains contained in the other unit layer being 0.3 to 2$\mu$ with the difference between these two silver halide emulsions in mean grain size being 0.1 to 1.5$\mu$.

14. The incorporated-coupler multi-layered color light-sensitive material according to claim 2, in which said light-sensitive emulsion layer unit comprising two or more unit layers comprises two unit layers, one layer having a higher sensitometric gamma value and comprising smaller silver halide particles of a (100) face and one larger having a lower sensitometric gamma value and comprising larger silver halide particles of a (111) face.

15. A process for producing color images excellent in color reproduction, which comprises color development-processing an exposed multi-layered color photographic light-sensitive material which comprises a support having thereon at least two light-sensitive emulsion layer units which provide, upon color development, images having substantially different hues, at least one of said light-sensitive emulsion layer units comprising two or more silver halide layers, and at least one of which unit layers contains an interlayer color correction uncolored coupler along or in combination with another coupler, and said interlayer color correction uncolored coupler is an interlayer color correction uncolored magenta coupler of the general formula (I*a*):

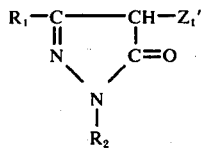

(Ia)

wherein $R_1$ represents a primary, secondary or tertiary alkyl group, an alkoxy group, an aryl group, an aryloxy group, a heterocyclic group, an amino group, a carbonamido group or a ureido group; $R_2$ represents an aryl group or a heterocyclic group and $Z_1'$ represents a heterocyclic imino group represented by the following general formula;

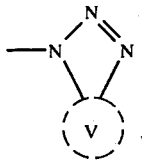

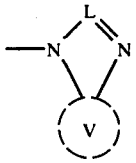

or

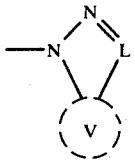

wherein V represents an aromatic ring of the benzene series or heteroaromatic ring containing at least one nitrogen atom, L represents a methine group or a derivative thereof, and V can be substituted with an amino group, an acylamino group, a halogen atom, an alkyl group, a nitro group, an alkoxy group, an alkylthio group, an arylthio group or an aryl group which, upon color development, is rapidly released and functions as a development restrainer;

an interlayer color correction uncolored yellow coupler of the general formula (II*a*):

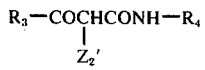

(IIa)

wherein $R_3$ represents a primary, secondary or tertiary alkyl group having 1 to 18 carbon atoms or an aryl group; $R_4$ represents an aryl group; and $Z_2'$ represents a heterocyclic imino group represented by the following general formula:

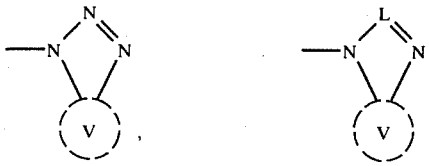

or

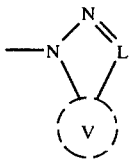

wherein V represents an aromatic ring of the benzene series or a heteroaromatic ring containing at least one nitrogen atom, L represents a methine group or a derivative thereof, and V can be substituted with an amino group, an acylamino group, a halogen atom, an alkyl group, a nitro group, an alkoxy group, an alkylthio group, an arylthio group or an aryl group which, upon color development, is rapidly released and functions as a development restrainer:

an interlayer color correction uncolored cyan coupler of the general formula (III*a*) or (IV*a*):

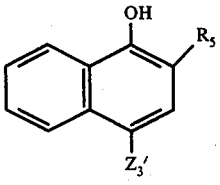

(IIIa)

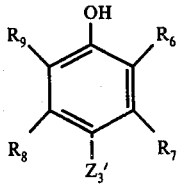

(IVa)

wherein $R_5$ represents a carbamyl group, a sulfamyl group, an alkoxycarbonyl group or an aryloxycarbonyl group; $R_6$ represents an alkyl group, an aryl group, a heterocyclic group, an amino group, a carbonamido group, a sulfonamido group, a sulfamyl group or a carbamyl group; $R_7$, $R_8$ and $R_9$ each represents a halogen atom, an alkoxy group, an alkyl group, an aryl group, a heterocyclic group, an amino group, a carbonamido group, a sulfonamido group, a sulfamyl group or a carbamyl group; and $Z_3'$ represents an iodine atom or a heterocyclic imino group represented by the following general formula;

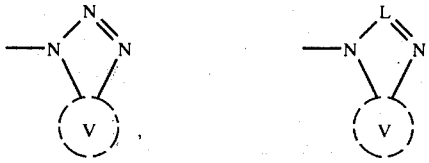

or

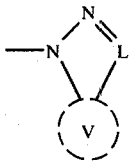

wherein V represents an aromatic ring of the benzene series or a heteroaromatic ring containing at least one nitrogen atom, L represents a methine group or a derivative thereof, and V can be substituted with an amino group, an acylamino group, a halogen atom, an alkyl group, a nitro group, an alkoxy group, an alkylthio group, an arylthio group or an aryl group which, upon color development, is released and functions as a development restrainer.

* * * * *